United States Patent [19]

Schmitt et al.

[11] 4,426,270

[45] Jan. 17, 1984

[54] MONOPOLAR FILTER-PRESS ELECTROLYZER

[75] Inventors: Helmut Schmitt, Dortmund; Helmuth Schurig, Holzwickede; Bernd Strasser, Hamm/Westf., all of Fed. Rep. of Germany

[73] Assignee: UHDE GmbH, Dortmund, Fed. Rep. of Germany

[21] Appl. No.: 402,313

[22] Filed: Jul. 27, 1982

[30] Foreign Application Priority Data

Aug. 4, 1981 [DE] Fed. Rep. of Germany ..... 3130806

[51] Int. Cl.[3] ..... C25B 9/00; C25B 15/08; C25B 11/03

[52] U.S. Cl. ..... 204/257; 204/279; 204/288; 204/284; 204/128

[58] Field of Search ..... 204/257-258, 204/279, 263-266, 288, 283-284

[56] References Cited

U.S. PATENT DOCUMENTS

| | | | |
|---|---|---|---|
| 4,069,129 | 1/1978 | Sato et al. | 204/258 |
| 4,252,628 | 2/1981 | Boulton et al. | 204/258 X |
| 4,274,939 | 6/1981 | Bjäreklint | 204/279 X |
| 4,309,264 | 1/1982 | Bender et al. | 204/258 X |
| 4,310,404 | 6/1982 | Satoh et al. | 204/279 X |

*Primary Examiner*—Donald R. Valentine
*Attorney, Agent, or Firm*—Wilson, Fraser, Barker & Clemens

[57] ABSTRACT

An electrolyzer is provided for processing fluids. The electrolyzer includes electrode plates having laterally extending electrical busses. The electrode plates are mounted in a non-conducting external frame having a plurality of ducts for the flow of process fluids between the electrolyte chamber and the ducts. Seals are provided between the electrode plates and the external frame.

1 Claim, 3 Drawing Figures

MONOPOLAR FILTER-PRESS ELECTROLYZER

BACKGROUND OF THE INVENTION

The invention relates to a monopolar filter-press electrolyzer suitable for the production of an aqueous alkali metal hydroxide solution (cell liquid) as well as halogen and hydrogen from an aqueous halogenide-bearing electrolyte (brine). The electrolyzer consists of two end plates with tie-bars, a plurality of alternating anolyte and catholyte chambers, and electrolyte chambers each having two anode and cathode plates which are separated by a flat membrane permeable to ions.

The process fluids such as brine, cell liquid, halogen, and hydrogen used in this filter-press type electrolyzer must be routed such as to prevent significant chemical attack on the metal of the anode and cathode plates.

Patent DE-OS 28 09 332, which corresponds to U.S. Pat. No. 4,252,628, describes a membrane electrolyzer of the filter-press type consisting of a plurality of successive anode and cathode plates separated by membranes and spaced by means of intermediate plates. The membrane cell described above possesses a large number of different components and gaskets.

SUMMARY OF THE INVENTION

The object of the present invention is to reduce the number of different components and, consequently, the number of gaskets.

According to the invention the anode and cathode plates do not only have an electrolytically active metal component but also a nonmetallic component with inlet and outlet ducts for the process fluids. The process fluids flow in either direction through corrugated bores which connect the ducts with the electrolyte chambers. The thickness of the intermediate plates arranged between each membrane and anode or cathode plate depends on the membrane intervals.

The advantages achieved by the invention are that the number of components is substantially reduced and, consequently, the number of gaskets. Fabrication and assembly of the electrolyzer are thus facilitated considerably.

The materials of the electrolyzer components correspond to the present state of technology and are not specified in detail.

BRIEF DESCRIPTION OF THE DRAWINGS

An embodiment of the invention is illustrated in the accompanying drawings and described in more detail below when considered in light of the drawings, in which.

DETAILED DESCRIPTION OF THE PREFERRED EMBODIMENT

Figure 1:
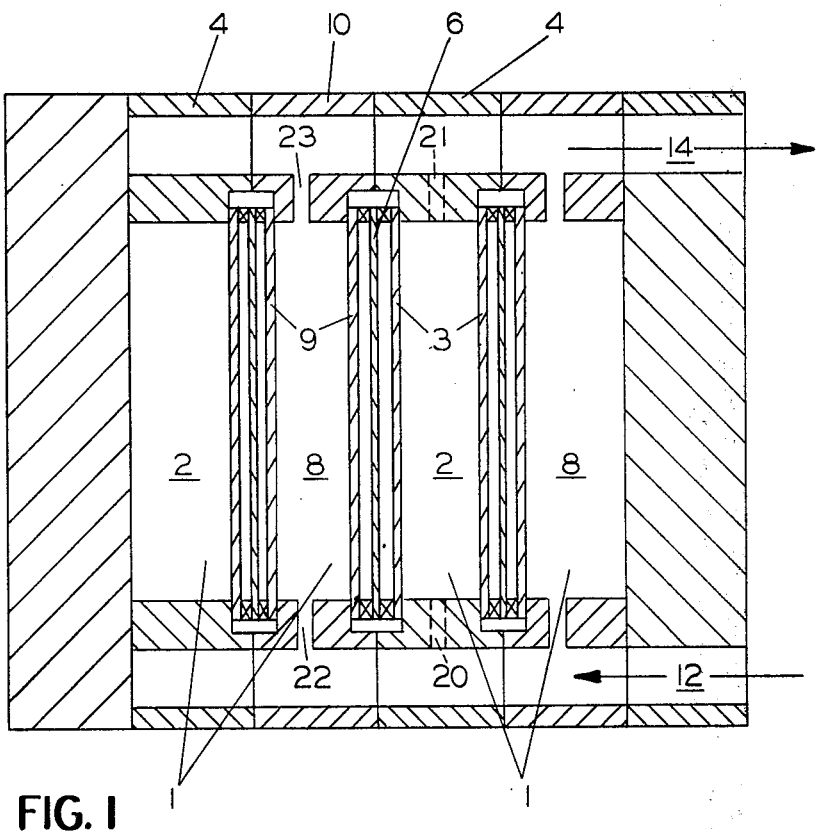
FIG. 1 is a cross sectional view of a filter-press electrolyzer having successive anode and cathode chambers.
Figure 2:
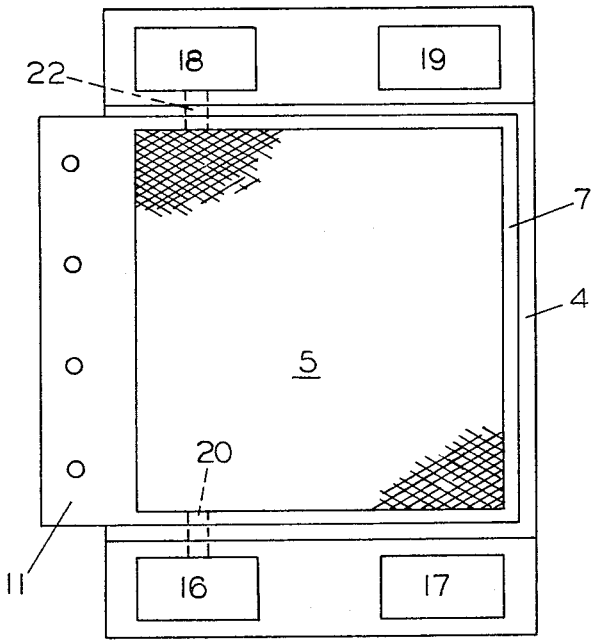
FIG. 2 is an elevational view of the electrode frame structure used in the anode chamber.
Figure 3:
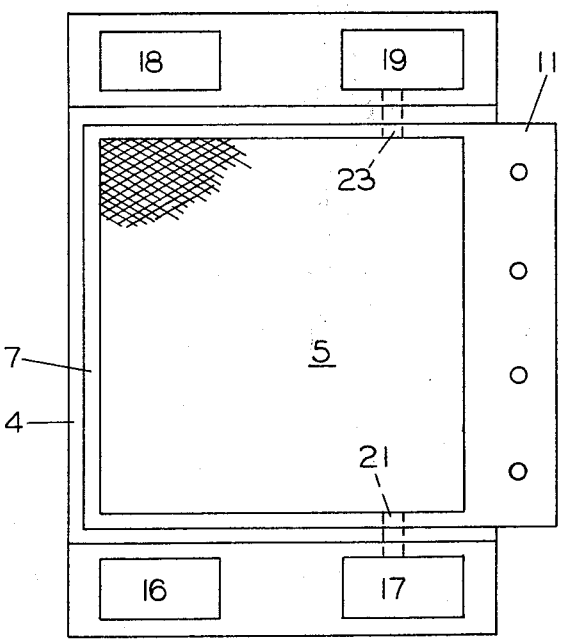
FIG. 3 is an elevational view of the electrode frame structure used in the cathode chamber.

The monopolar filter-press electrolyzer consists of a plurality of electrolyte chambers 1 which have different polarities, see FIG. 1. An anolyte chamber 2 is formed by two metal electrode plates 3 and a nonmetallic frame 4 which constitute the perimeter of the chamber. The plate intervals depend on the external frame 4. Whereas the internal surface area 5, see FIG. 2, of the plates is permeable to gas and liquids, thus permitting a flow of the liquid and an escape of the gas. A plate frame 7 is impermeable to the flow of liquid and gas, and housed in the external frame 4. A membrane 6 separates the anolyte chamber 2 from a catholyte chamber 8, see FIG. 1. The catholyte chamber 8 has two electrode plates 9 and an external frame 10 which also constitute the perimeter of this chamber 8. Each electrode plate has a lateral electrical bus portion 11. The external frames 4 and 10 of the electrolyte chambers have several ducts which serve as inlet and outlet for the flow of process fluids. Accordingly, each frame is provided with four passages 16, 17, 18, and 19. When a plurality of frames is assembled, four ducts extending in a longitudinal direction are defined, i.e., a duct 12 for brine, a duct 13 for cell liquid, a duct 14 for halogen, and a duct 15 for hydrogen arranged to coincide with the passages 16, 17, 18, and 19, respectively. Moreover, frame 4 of anolyte chamber 2 is provided with two bores 20 and 21, one for feeding process fluids to, and one for evacuating the fluids from, the electrolyte chamber. These bores connect the anolyte chamber with brine duct 12 and halogen duct 14. Frame 10 of catholyte chamber 8 is also provided with two bores 22 and 23 which connect the catholyte chamber 8 with cell liquid duct 13 and hydrogen duct 15. The electrolyzer components are sealed against each other by means of gaskets or vulcanized material.

What is claimed is:

1. A monopolar filter-press electrolyzer for the production of an aqueous alkali hydroxide solution, halogen and hydrogen from an aqueous halogenide-bearing electrolyte, the electrolyzer including two end plates connected by tie-bars, a plurality of conductive electrode plates, electrolyte chambers, intermediate membranes, inlet and outlet ducts for the process fluids and the necessary gaskets; the improvement comprising: a plurality of external, non-conductive frame members positioned between the two end plates and adapted to support a separate electrode plate and membrane assembly between adjacent ones of said frame members, said electrode plate and membrane assembly including a pair of spaced apart electrode plates having an intermediate membrane positioned therebetween, each of said electrode plates having an internal portion permeable to gas and liquid and an integral outer peripheral portion impermeable to gas and liquid, said outer peripheral portion having a laterally extending electrical buss, and means for maintaining said plates and said membrane is spaced apart relationship, each of said frame members provided with means for supporting said electrode plate and membrane assembly between adjacent ones of said frame members, said supporting means including a recessed portion formed in at least one side of one of said frame members for receiving and sealingly engaging the outer peripheral portion of said electrode plate located on one side of said electrode plate and membrane assembly, while the adjacent frame member sealingly engages the outer peripheral portion of said electrode plate located on the opposite side of sai,d electrode plate and membrane assembly, each of said frame members having an internal chamber formed therein which cooperates with the electrode plate and membrane assembly positioned adjacent thereto for defining one of the electrolyte chambers, said frame members provided with passages for the flow of the process fluids between the electrolyte chambers and the inlet and outlet ducts.

* * * * *